United States Patent [19]

Tesch

[11] 4,355,501

[45] Oct. 26, 1982

[54] EXPANSION BAND, SUCH AS A WATCH BAND, JEWELRY BAND OR THE LIKE

[75] Inventor: Bernhard Tesch, Ennetbuergen, Switzerland

[73] Assignees: Zwyro A.G., Schaffhausen; Tesch A.G., Ennetburgen, both of Switzerland

[21] Appl. No.: 155,230

[22] Filed: Jun. 2, 1980

Related U.S. Application Data

[63] Continuation of Ser. No. 941,251, Sep. 11, 1978, abandoned.

[30] Foreign Application Priority Data

Sep. 10, 1977 [DE] Fed. Rep. of Germany ..... 2740916

[51] Int. Cl.[3] ..... F16G 13/00

[52] U.S. Cl. ..... 59/82; 63/4

[58] Field of Search ..... 59/80, 82; 63/4; 224/179

[56] References Cited

U.S. PATENT DOCUMENTS 3,857,237 12/1974 Brauchi .

*Primary Examiner*—Mark Rosenbaum

*Attorney, Agent, or Firm*—Diller, Ramik & Wight

[57] ABSTRACT

This disclosure is directed to an expansion band particularly adapted for use as a watch band, jewelry band, bracelet or the like in which a plurality of links are pivotally connected to each other by pins received in recesses, and means for locking adjacent links to each other with the adjacent links having size in contiguous relationship, and fin means projecting laterally from the side of one adjacent link for reception in recess means in the side of a second adjacent link whereby a gap between adjacent links is bridged by the fin means.

17 Claims, 10 Drawing Figures

EXPANSION BAND, SUCH AS A WATCH BAND, JEWELRY BAND OR THE LIKE

This is a continuation, of application Ser. No. 941,251 filed Sept. 11, 1978, now abandoned.

The present invention is directed to an expansion band particularly the type adapted for use as a watch band, jewelry band, bracelet or the like which is assembled by pivotally or articulately connecting together a plurality of individual links.

Expansion bands or bracelets of the type to which this invention is directed have been manufactured in recent times from links in the shapes of blocks, plates or boxes of either solid material or sheet material folded or bent upon itself. The intent in all such conventional bands is to have all adjacent links about each other as tightly as is possible in order to obtain the actual or at least visual effect of a completely closed band, i.e., the absence of a gap between opposing faces of adjacent links. This desire is, however, countered in some degree by the fact that the band must be sufficiently mobile to adapt itself to the various body shapes and dimensions. When the expansion band is lengthened linearly or in a curved fashion, the gaps between adjacent links can not be avoided and such gaps are unaesthetic in appearance and detract from the overall concept of expansion bands, namely, creating the appearance of a solid band when in fact the band is not solid. When the gaps are relatively large, one sees through these gaps into a darkened space beneath the band and thus might see the exposed flesh of the individual wearing the band or the conventional locking pins or like latching elements connecting the individual links to each other. The latter is again undesirable from the standpoint of aesthetic and additionally dirt can collect in the gaps between the links which is again undesirable from an esthetic standpoint but is also undesirable from a pure operability standpoint since such dirt can adversely effect the overall operation of the band as it is expanded or contracted. The latter applies particularly to expansion bands or bracelets in which the links are joined by telescoping elements (pins and recesses), and in which in their most compact state (totally contracted) are secured together by a conventional locking mechanism (locking pin).

In accordance with the present invention, the disadvantages noted heretofore are avoided by the creation of an expansion band which is of a wholly closed appearance, at least when viewed from the outside, and means are provided which hide individual links and bridge the conventional gap between the sides of adjacent links. This is true even though the expansion band of the invention is formed of a plurality of individual links pivotally interconnected to each other through pins and recesses in a telescopic fashion with adjacent links being secured to each other by a detachable lock through the use of projecting fins of one link being received in recesses of another link with fins bridging the gap between the adjacent sides of adjacent links.

In further accordance with this invention the projecting fins are of a length that they will slightly penetrate the recesses of the associated link even at maximum spacing between adjacent links (maximum expansion of the expansion band). The fins or protrusions and the recesses preferably extend along the entire length or sides of the links from end to end thereof or may be disposed in an offset comb-like manner with the fins all being disposed on one link, and the recesses all being disposed on the other link, or again alternatively by fins and recesses being located on the same opposing sides of adjacent links.

In further accordance with this invention, the fins are outermost and above the interlocking or pivotal connecting means (pins) thus hiding the same when the expansion band is in use (outermost surface disposed outermost of the user's wrist or the like).

In further accordance with this invention, the fins and recesses may at least be in part integrated with the interconnecting pins and recesses forming the pivotal connecting means of adjacent links.

In further accordance with this invention, the fins are formed along the entire length of the side edges of the links and may be manufactured into a rolled profile. In such cases, it is both advantageous and sufficient to use locking means in the forms of pins of circular cross-section for connecting the adjacent links to each other and preferably the latter pins are disposed with their axis at an angle transverse to the longitudinal axis of the links and thus transverse to the gap therebetween with the pins being disposed in associated bores of adjacent links.

With the above and other objects in view that will hereinafter appear, the nature of the invention will be more clearly understood by reference to the following detailed description, the appended claims and the several views illustrated in the accompanying drawings.

IN THE DRAWINGS

Figure 1:
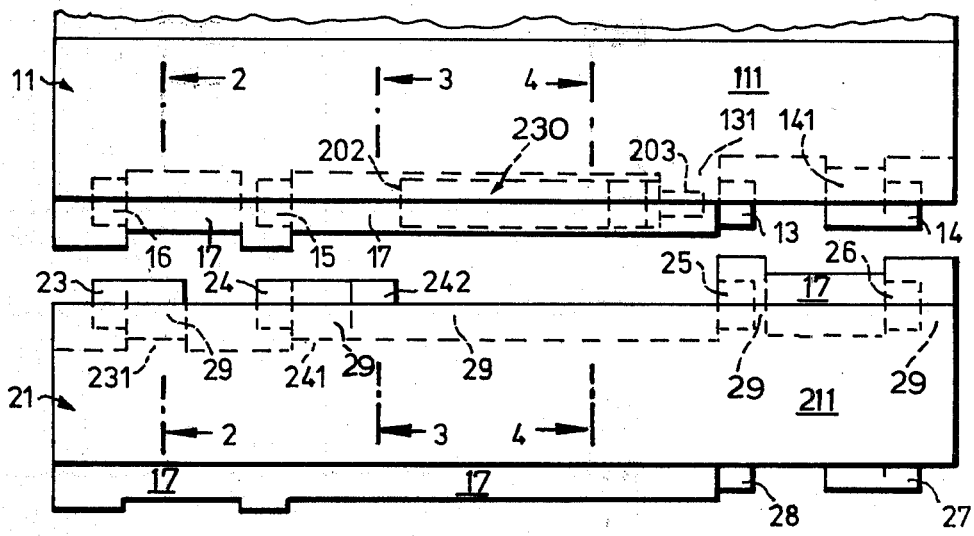
FIG. 1 is a fragmentary top plan view looking at the exterior of a pair of adjacent links of an expansion band, and illustrates pins and recesses for pivotally connecting adjacent links to each other along sides thereof, as well as laterally projecting fins which are received in recesses to bridge the gap between adjacent links.

FIGS. *6a* through *6e* are fragmentary schematic views of modifications of the links, and illustrate differing fin profiles and locking pins disposed transversely to the lengths of adjacent pins in bridging relationship to the gap therebetween.

Reference is made particularly to FIGS. 1 through 5 of the drawings which illustrate an expansion band generally designated by the reference numeral 10 which may be, for example, a watch band, jewelry band, bracelet or the like.

The watch band 10 includes a plurality of adjacent links of which are fully illustrated links 11 and 21. The links 11, 21 are basically of a rotationally symmetric design, that is, they may be positioned and locked together or with any other link along the entire expansion band 10.

Each of the links 11, 21 is provided with means for pivotally connecting the same to each other in the form of pivot pins 13, 14 of the link 11 which are pivotally connected in telescopic relationship within respective recesses 25, 26 of the link 21. Likewise, pivot pins 23, 24 of the link 21 are received in recesses 16, 15, respectively, of the link 11. For completeness of disclosure, pivot pins 26, 28 of the link 21 are illustrated at the side and corner opposite to the location of the pivot pins 23, 24, respectively.

The pivot pins 13, 14 are carried by arms 131, 141, respectively. The pivot pins 23, 24 are similarly carried by respective arms 231, 241. An arm 271 (FIG. 2) is also illustrated and the latter carries the pivot pin 27.

Figure 2:
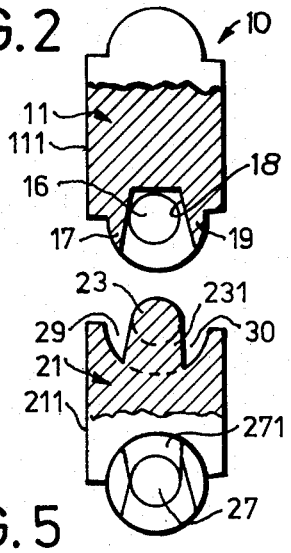
FIG. 2 is a cross-sectional view taken generally along line 2—2 of FIG. 1, and illustrates a pair of projecting fins of one link and the associated recesses or grooves of the adjacent link.
Figure 3:
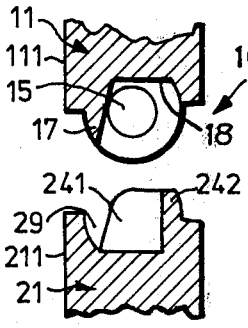
FIG. 3 is a fragmentary sectional view taken generally along line 3—3 of FIG. 1, and illustrates a single fin of one link adapted for reception in a single groove of the adjacent link.
Figure 4:
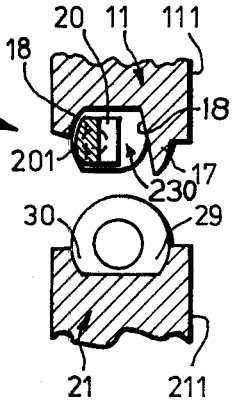
FIG. 4 is a fragmentary sectional view taken generally along line 4—4 of FIG. 1, and illustrates a fin carried by an opposite link for reception in a groove of the adjacent link.
Figure 5:
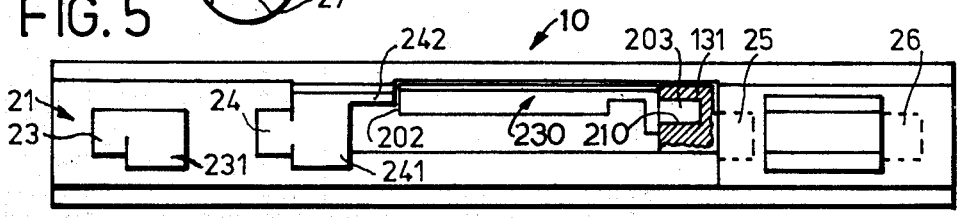
FIG. 5 is a side elevational view of the lower link shown in FIG. 1, and illustrates a spring locking pin for securing adjacent links to each other.

Reference is now made specifically to FIG. 2 of the drawings in which the link 11 is illustrated as carrying fin means in the form of a pair of fins or projections 17, 19 disposed on opposite sides of the recess 16 and projecting away from a lateral side (unnumbered) of the link 11 which faces a like lateral side (unnumbered) of the link 21. Exterior surfaces (unnumbered) of the fins 17, 19 are slightly curved while interior surfaces (unnumbered) of the fins 17, 19 in part define a recess 18 which is contoured to receive the arm 231 when the pin 23 is seated within the recess 16. The fin 17 is disposed adjacent an exterior surface 111 of the link 11. The line 21 includes recess means in the form of recesses 29 and 30 which open in a direction toward and contoured to receive the fins 17, 19, respectively, of the link 11 with an exterior surface 211 of the link 21 being in a common plane with the exterior surface 111 of the link 11 when the latter two links 111, 211 are in a completely flat state.

When the adjacent links 11 and 21 are interconnected with the pins 13, 14 in the recesses 25, 26 and the pins 23, 24 in the recesses 16, 15, the fins 17, 19 will seat in the respective recesses or grooves 29, 30 and in this manner the exterior fin 17 will bridge any gap (not shown) which exists between the opposing side surfaces (unnumbered) of the links 11, 21 thereby hiding from exterior view the various pins 13, 14, 23, 24, 27 and 28, as well as locking means which will be described hereinafter. Thus, irrespective of whether adjacent links 11, 21 are totally or fully pivoted in one direction or an opposite direction or are completely in a uni-planar relationship to each other, any gap between the opposing surfaces of the sides of the links 11, 21 will be bridged by the fins 17, 19 and particularly the exterior fin 17. In this fashion, when the expansion band is viewed in its use position (FIG. 1 interlocked), any gap between the opposing sides of the links 11, 21 is bridged by the fin 17 while the comparable bottom fin 19 serves the same function.

As is particularly illustrated in FIG. 1, the fin 17 and its corresponding fin 19 occupy a position generally between the pin 13 and the recess 16 of the link 11 while a like fin 17 occupies a position relative to the link 21 between the recesses 25 and 26.

Thus, the fins 17, 19 and the recesses 29, 30 are carried by both of the links 11, 21 and thereby bridge the gap between the opposing sides of the adjacent links 11, 21 virtually between the entire length of the links.

After the links 11, 21 have been pivotally connected to each other in the manner heretofore described, the adjacent links are locked to each other by locking means in the form of a locking pin 230 which is a length of spring material having a rounded side 201 and which is received in the recess 18 which opens in opposing relationship to a like recess (unnumbered in FIG. 4) formed in part by the recesses 29, 30. The curved surface 201 of the locking means 230 thereby spans the gap between the opposing sides of the links 11, 21 at the underside of the latter links, as is readily apparent from FIG. 4. The locking means 230 has one end 202 abutting an extension 242 (FIG. 5) of the arm 241 and an opposite end of the locking means 230 carries a pin 203 received in recess or bore 210 of the arm 131. The locking means 230 can flex about is longitudial axis and when unflexed is in its linear position shown in FIG. 5 locking the adjacent links 11, 21 to each other. The locking means 230 need only be bent against its inherent flexibility for withdrawal from and reinsertion into the opposing recesses 18, 29, 30 the bore 210 and the end face (unnumbered) of the extension 242 of the arm 241.

Figure 6:
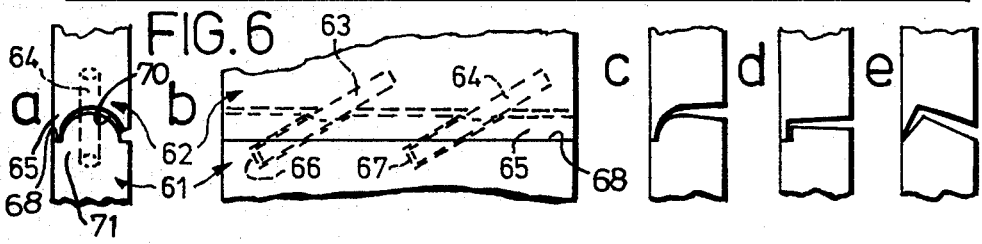

Reference is now made to FIGS. 6*a* and 6*b* of the drawings which illustrates a pair of links 61, 62 manufactured as rolled profiles or sections from metallic material, such as stainless steel, as are the profiled rolled sections of the unnumbered links of FIGS. 6*c*, 6*d* and 6*e*. In FIGS. 6*a* and 6*b* a single fin 65 running the entire length of the link 62 is received in a recess 68 of the link 61. The link 61 also includes a semicylindrical projection 71 running the entire length thereof which is received in a like contoured recess 70 also extending the entire length of the link 62. In keeping with this embodiment of the invention, locking means in the form of solid or extensible pins 63, 64 are received in respective recesses 66, 67 of the link 61. The pins 63, 64 may be simply formed of spring material to permit the adjacent links 61, 62 to articulate relative to each other. The links 61, 62 may be locked to each other in much the same manner at that heretofore described with respect to the locking means 230 of the band 10.

Although only a preferred embodiment of the invention has been specifically illustrated and described herein, it is to be understood that minor variations may be made in the apparatus without departing from the spirit and scope of the invention, as defined in the appended claims.

I claim:

1. An expansion band particularly adapted for use as a watchband, jewelry band, bracelet or the like comprising a plurality of links, means pivotally connecting adjacent links to each other, means for locking adjacent links to each other, adjacent links having sides in contiguous relationship to each other, fin means projecting laterally from the side of one adjacent link for reception in recess means in the side of a second adjacent link whereby a gap between adjacent links is bridged by said fin means, said pivotal connecting means including a male pivot pin projecting from the side of one link and being received in a bore of a trunnion projecting from the side of another link, and said fin means being defined by a wall common to said trunnion.

2. The expansion band as defined in claim 1 wherein an additional male pivot pin projects from the side of said one link and is received in another bore of another trunnion projecting from the side of said another link, and said common wall spans the distance between said trunnions.

3. The expansion band as defined in claim 1 wherein an additional male pivot pin projects from the side of said one link and is received in another bore of another trunnion projecting from the side of said another link, and said common wall spans the distance between said turnnions and projects beyond one of said first-mentioned and another trunnions.

4. An expansion band particularly adapted for use as a watchband, jewelry band, bracelet or the like comprising a plurality of links, means pivotally connecting adjacent links to each other, means for locking adjacent links to each other, adjacent links having sides in contiguous relationship to each other, fin means projecting laterally from the side of one adjacent link for reception in recess means in the side of a second adjacent link whereby a gap between adjacent links is bridged by said fin means, said pivotal connecting means including a male pivot pin projecting from the side of one link and being received in a bore of a trunnion projecting from the side of another link, and said fin means including a pair of walls carried by said one link disposed on opposite sides of said male pivot pin and defining therewith a recess for receiving said trunnion.

5. An expansion band particularly adapted for use as a watchband, jewelry band, bracelet or the like comprising a plurality of links, means pivotally connecting adjacent links to each other, means for locking adjacent links to each other, adjacent links having sides in contiguous relationship to each other, fin means projecting laterally from the side of one adjacent link for reception in recess means in the side of a second adjacent link whereby a gap between adjacent links is bridged by said fin means, said pivotal connecting means including a male pivot pin projecting from the side of one link and being received in a bore of a trunnion projecting from the side of another link, said fin means including a pair of walls carried by said one link disposed on opposite sides of said male pivot pin and defining therewith a recess for receiving said trunnion, and said fin means further including a wall common to said trunnion.

6. An expansion band particularly adapted for use as a watchband, jewelry band, bracelet or the like comprising a plurality of links, means pivotally connecting adjacent links to each other, means for locking adjacent links to each other, adjacent links having sides in contiguous relationship to each other, a pair of fin means separated by recess means along a side of one adjacent link in registry with a pair of recess means separated by fin means along a side of a second adjacent link whereby a gap between adjacent links is bridged by said fin means, and said fin means all project laterally away from their respective link sides for reception in their respective recess means.

7. An expansion band as defined in claim 6 wherein said fin means and recess means have a common surface along said link sides.

8. An expansion band particularly adapted for use as a watchband, jewelry band, bracelet or the like comprising a plurality of links, means pivotally connecting adjacent links to each other, means for locking adjacent links to each other, adjacent links having sides in contiguous relationship to each other, fin means projecting laterally from the side of one adjacent link for reception in recess means in the side of a second adjacent link whereby a gap between adjacent links is bridged by said fin means, at least two of said fin means being spaced from each other along the length of each link, and at least two of said recess means being spaced from each other along the length of each link.

9. An expansion band particularly adapted for use as a watchband, jewelry band, bracelet or the like comprising a plurality of links, means pivotally connecting adjacent links to each other, means for locking adjacent links to each other, adjacent links having sides in contiguous relationship to each other, fin means projecting laterally from the side of one adjacent link for reception in recess means in the side of a second adjacent link whereby a gap between adjacent links is bridged by said fin means, and said locking means being disposed in bridging relationship to said gap and within opposing aligned slots in each link sides.

10. An expansion band particularly adapted for use as a watch band, jewelry band, bracelet or the like comprising at least two links each having an outer surface, an inner surface, opposite end surfaces and opposite side surfaces, means for pivotally connecting said links to each other, a first of said links being disposed with a first side surface thereof in opposed spaced relationship to a first side surface of a second of said links, each first side surface being defined between an outer terminal side edge common to an associated outer surface and an inner side edge disposed between associated inner and outer surfaces, said first side surfaces defining a gap therebetween of a predetermined size when said links are generally disposed in coplanar relationship and increasing in size as said links pivot such that said outer terminal side edges move away from each other, a fin set-off in part by a surface beginning at said second link inner side edge and projecting toward said first link first side surface and across said gap, a recess set-off in part by a surface beginning at said first link inner side edge and extending away from said second link first side surface and receiving therein said fin whereby irrespective of the degree to which the links are pivoted relative to each other said gap is at all times bridged by said fin, each of said links includes an inner terminal side edge common to an associated inner surface, said pivotally connecting means being defined by a pivot pin carried by at least one of said links received in a recess of another of said links, and said fin is positioned between said pivot pin receiving recess and one of said inner and outer surfaces.

11. The expansion band as defined in claim 10 wherein said pivot pin is carried by an arm projecting toward said gap, and said fin receiving recess is additionally set-off by an exterior surface of said arm.

12. The expansion band as defined in claim 10 wherein said pivot pin and fin receiving recess are carried by said first link and said fin and pivot pin receiving recess are carried by said second link.

13. The expansion band as defined in claim 12 wherein said pivot pin is carried by an arm projecting toward said gap, and said fin receiving recess is additionally set-off by an exterior surface of said arm.

14. The expansion band as defined in claim 12 wherein said second link includes a second fin and said first link includes a second recess receiving therein said second fin, said pivot pin receiving recess being disposed between said first-mentioned fin and second fin, and said pivot pin being disposed between said first-mentioned and second fin receiving recesses.

15. The expansion band as defined in claim 14 including an arm carrying said pivot pin and in part defining portions of said first-mentioned and second fin receiving recesses.

16. The expansion band as defined in claim 15 including means for imparting an axial force to said pivot pin to hold the same in said pivot pin receiving recess.

17. An expansion band particularly adapted for use as a watch band, jewelry band, bracelet or the like comprising at least two generally parallel oriented links each having an outer surface, an inner surface, opposite end surfaces and opposite side surfaces, means for pivotally connecting said links to each other, a first of said links being disposed with a first side surface thereof in opposed spaced relationship to a first side surface of a second of said links, each first side surface being defined between an outer terminal side edge common to an associated outer surface and an inner side edge disposed between associated inner and outer surfaces, said first side surfaces defining a gap therebetween of a predetermined size when said links are generally disposed in coplanar relationship and increasing in size as said links pivot such that said outer terminal side edges move away from each other, a fin set-off in part by a surface beginning at said second link inner side edge and projecting toward said first link first side surface and across said gap, a recess set-off in part by a surface beginning at said first link inner side edge and extending away from said second link first side surface and receiving therein said fin whereby irrespective of the degree to which the links are pivoted relative to each other said gap is at all times abridged by said fin, said pivotal connecting means includes a trunnion projecting from said second link side surface, said trunnion including a bore for receiving a pivot pin projecting from said first link side surface, and said trunnion and fin having a common wall.

* * * * *